US006394315B1

(12) United States Patent
Banks

(10) Patent No.: US 6,394,315 B1
(45) Date of Patent: May 28, 2002

(54) SQUEEZE OPERATED FOAM DISPENSER

(75) Inventor: Stewart Banks, Lagoa (PT)

(73) Assignee: Deb IP Limited, Belper (GB)

( * ) Notice: Subject to any disclaimer, the term of this patent is extended or adjusted under 35 U.S.C. 154(b) by 0 days.

(21) Appl. No.: 09/649,049

(22) Filed: Aug. 29, 2000

Related U.S. Application Data

(63) Continuation-in-part of application No. 09/566,633, filed on May 8, 2000.

(51) Int. Cl.[7] ..... B67D 5/58
(52) U.S. Cl. ..... 222/190; 222/209; 222/211
(58) Field of Search ..... 222/190, 209, 222/211

(56) References Cited

U.S. PATENT DOCUMENTS

| | | | |
|---|---|---|---|
| 3,422,993 | A | 1/1969 | Boehm et al. |
| 4,324,349 | A | 4/1982 | Kaufman |
| 4,531,659 | A | 7/1985 | Wright |
| 4,596,343 | A | 6/1986 | Ford, Jr. |
| 4,846,376 | A | 7/1989 | Palmer |
| 5,037,006 | A | 8/1991 | Kock |
| 5,984,146 | A | 11/1999 | Kaufman |

FOREIGN PATENT DOCUMENTS

| | | |
|---|---|---|
| WO | 9109682 | 7/1991 |

*Primary Examiner*—Henry C. Yuen
*Assistant Examiner*—Melvin Cartagena

(74) *Attorney, Agent, or Firm*—Nancy E. Hill; Hill & Schumacher

(57) ABSTRACT

A foam dispenser for use in association with foaming liquid is disclosed. The squeeze operated foam dispenser includes a resiliently deformable bottle and a cap. The resiliently deformable bottle has an at rest position and an under pressure position. The bottle has an interior and a throat. The cap is attached to the throat and the cap has a nozzle extending inwardly into the interior of the bottle. The nozzle defines a nozzle fluid passageway. A nozzle cover is attached to the cap and spaced from the nozzle and a cap chamber is defined therebetween. An air tube defining an air passageway extends inwardly from the nozzle cover and the air passageway is in communication with the cap chamber and an interior portion of air formed between the liquid and the bottle in the interior thereof when the nozzle is positioned downwardly. A pressure actuated valve selectively opens and closes the air tube whereby the valve is closed when the bottle is in the at rest position and opens responsive to the bottle being moved from the at rest position to the pressure position. A cover port is formed in the nozzle cover to provide a fluid passageway between the interior and the cap chamber. The dispenser includes a method of sealing the nozzle when the bottle is in the at rest position. The sealing method may be a pressure retaining valve. Alternatively the cover port, the nozzle and the nozzle cover are arranged whereby, in the at rest position with the throat of the bottle positioned downwardly, there is an airlock between the nozzle and nozzle cover in the cap chamber and when the bottle is moved from the at rest position to the pressure position the air lock is broken.

20 Claims, 11 Drawing Sheets

SQUEEZE OPERATED FOAM DISPENSER

RELATED APPLICATIONS

This application is a continuation-in-part application of U.S. patent application Ser. No. 09/566,633 filed May 8, 2000.

FIELD OF THE INVENTION

This invention relates to foam dispensers and in particular to squeeze operated foam dispensers.

BACKGROUND OF THE INVENTION

Liquid dispensers for dispensing soap and the like are well known. There are a wide variety of liquid dispensers for use in association with liquid soap. Some of these dispense the soap or other liquid in the form of a foam.

A common dispenser for liquid soap includes a cap with a nozzle portion that pivots from an in use position to a stowed position. In the in use position the nozzle is in flow communication with the interior of the dispenser. In the stowed position the distal end of the nozzle is inside the cap and thus liquid cannot escape. The advantage of this common dispenser cap is that it uses relatively few parts and is easy to use. The disadvantage is that when the dispenser is in the nozzle down position and the nozzle is in the in use position liquid will likely seep out continuously. A further disadvantage is that this can only be used in association with regular soap and it cannot be used to produce a foam.

Another dispenser for liquid soap is shown in U.S. Pat. No. 4,324,349 issued to Kaufman on Apr. 13, 1982. This dispenser includes a squeeze bottle, an air pocket structure disposed at the lower end of the bottle. The air pocket structure is in flow communication with the inside of the bottle and has an outlet so that liquid can flow from the bottle into the air pocket and out the outlet. The disadvantage of this squeeze bottle is that it can only be used in association with regular soap. It will not produce a foam.

Alternatively foam dispensers are used to dispense soap in the form of foam. The advantage of these dispensers is there tends to be much less waste due to splashing or run-off since the foam has a much higher surface tension than the corresponding liquid. In addition, foam tends to be much easier to spread than the corresponding liquid. Foam dispensers typically fall into two general types. One type produces foam by injecting a jet of air. The second type uses a porous material or mesh and a combination of liquid and air is mixed together and then forced through the mesh to form a foam.

One example of a foam dispenser is shown in U.S. Pat. No. 5,984,146 issued Nov. 16, 1999 to Kaufman. This foam dispenser includes a reservoir for containing a pool of liquid up to a predetermined level. The foam dispenser includes a discharge chamber which contains air above the level of the liquid and a discharge device which extends upwardly from the reservoir at least partly through the discharge chamber. The discharge device has an external outlet. The discharge device includes a foam chamber and pressure means, whereby pressure applied to the liquid in the reservoir drives liquid into the discharge device. This foam dispenser has a number of disadvantages. Specifically this foam dispenser includes a separate discharge or air chamber, which causes the device to be quite bulky. This foam dispenser has a number of components which make it more costly to manufacture than a device with fewer components. Further, the foam chamber of this foam dispenser has a plurality of very small pinprick sized holes in a tubular portion which would be difficult and expensive to produce. In addition, to modify this foam dispenser to produce different foam characteristics or to use a different consistency of foaming soap would require modifying the foam chamber and would be difficult and expensive to do.

Accordingly it would be advantageous to provide a foam dispenser that uses relatively few components, that is easy to produce and that is easy to use. Further it would be advantageous to provide a foam dispenser that is relatively compact.

SUMMARY OF THE INVENTION

The present invention provides a liquid dispenser for use in association with foaming liquid. The liquid dispenser includes a resiliently deformable bottle and a cap. The resiliently deformable bottle has an at rest position and an under pressure position. The bottle has an interior and a throat. The cap is attached to the throat and the cap has a nozzle extending inwardly into the interior of the bottle. The nozzle defines a nozzle fluid passageway. A nozzle cover is attached to the cap and spaced from the nozzle and a cap chamber is defined therebetween. An air tube defining an air passageway extends inwardly from the nozzle cover and the air passageway is in communication with the cap chamber and an interior portion of air formed between the liquid and the bottle in the interior thereof when the nozzle is positioned downwardly. A pressure actuated valve selectively opens and closes the air tube whereby the valve is closed when the bottle is in the at rest position and opens responsively to the bottle being moved from the at rest position to the under pressure position. A cover port is formed in the nozzle cover to provide a fluid passageway between the interior and the cap chamber. The dispenser includes a method of sealing the nozzle when the bottle is in the at rest position. The sealing method may be a pressure retaining valve. Alternatively the cover port, the nozzle and the nozzle cover are arranged whereby, in the at rest position with the throat of the bottle positioned downwardly, there is an airlock between the nozzle and nozzle cover in the cap chamber and when the bottle is moved from the at rest position to the pressure position the air lock is broken.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
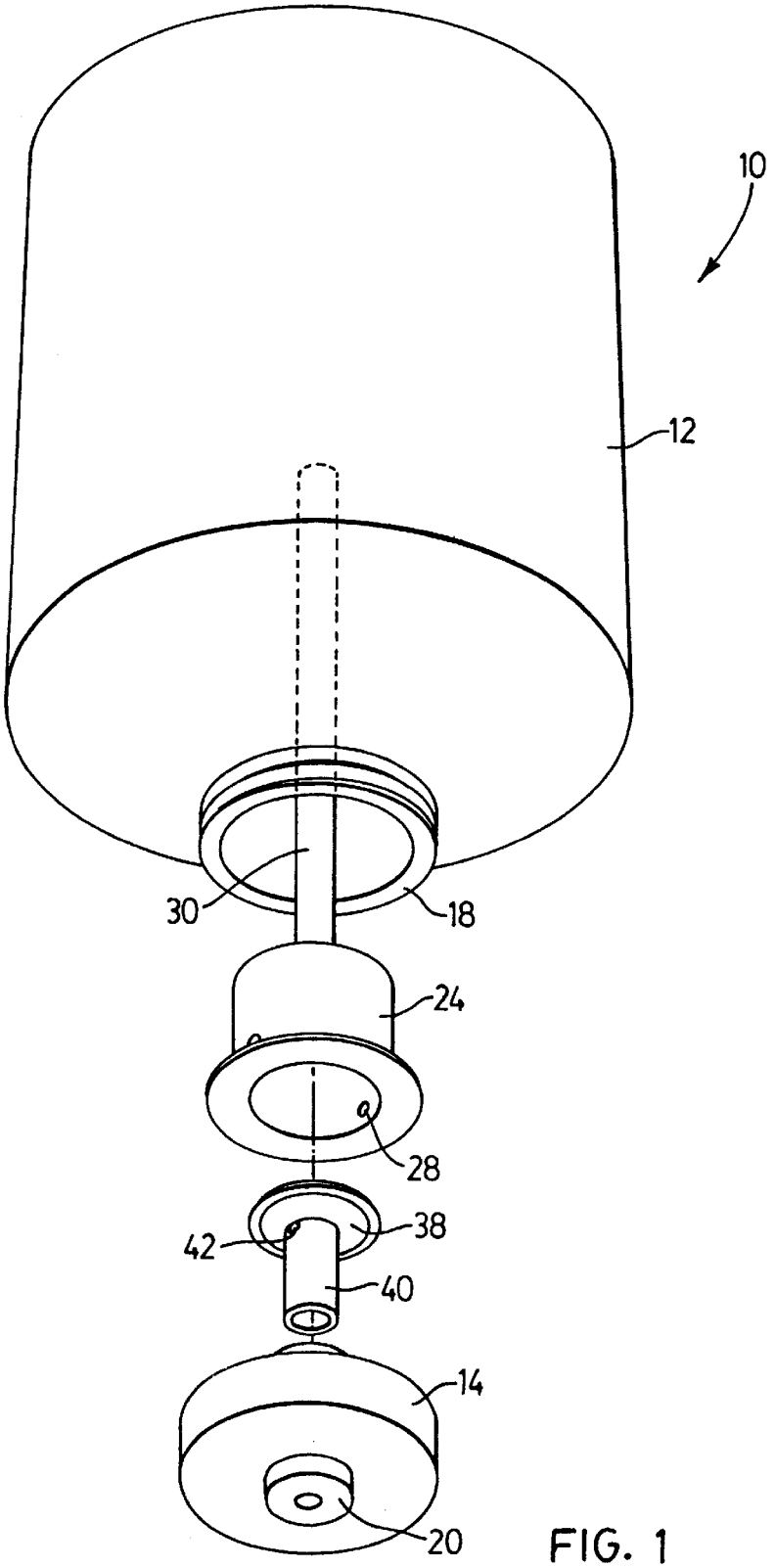
FIG. 1 is a blown apart perspective view of the squeeze operated foam dispenser of the present invention.
Figure 2:
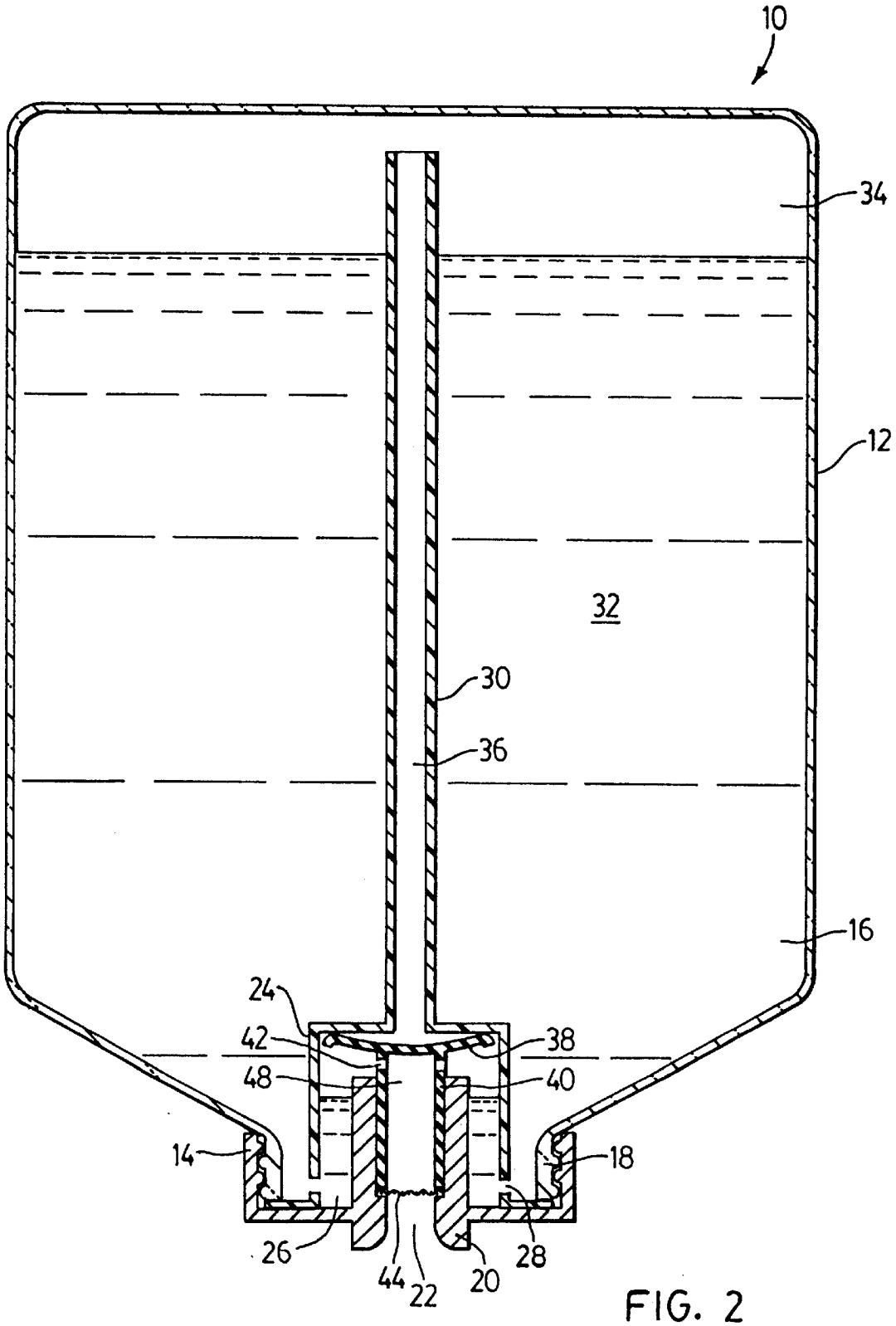
FIG. 2 is a sectional view of the liquid dispenser of FIG. 1.

Referring to FIGS. 1 and 2, a squeeze operated foam dispenser constructed in accordance with the present invention is shown generally at 10. Dispenser 10 includes a resiliently deformable bottle 12 and a cap 14.

Resiliently deformable bottle 12 is designed such that when pressure is exerted on the bottle, the bottle will deform to an under pressure position (not shown). Thereafter, when pressure is released the bottle will return to its original shape or an at rest position. Pressure may be exerted on the bottle by squeezing it between the user's fingers and a thumb, by using a lever mechanism, by using an electric solenoid, by using a motor and the like. Bottle 12 has an interior 16 and it narrows at one end thereof to form a throat 18.

Cap 14 is attached to the throat 18 of the resiliently deformable bottle 12. Cap 14 includes a nozzle 20 defining a nozzle passageway 22. Nozzle passageway 22 extends inwardly into the interior 16 of the bottle 12. A nozzle cover 24 is attached to the cap 14 and encloses the nozzle 20 and an annular cap chamber 26 is defined therebetween. A pair of cover ports 28 provide a fluid passageway between the interior 16 and the cap chamber 26. It will be appreciated by those skilled in the art that one cover port 28 or a plurality of cover ports 28 could be used.

An air tube 30 extends from the nozzle cover 24 into the interior 18 of bottle 12 proximate to the top end thereof when the nozzle is positioned downwardly as shown in FIG. 2. Foaming liquid 32 is placed in the interior 16 of bottle 12 such that there is at least an interior portion of air 34 in the bottle. Air tube 30 extends from the nozzle cover 24 into the interior portion of air 34 when the nozzle is positioned downwardly.

The air tube 30 defines an air passageway 36 such that the interior 16 of the bottle 12 is in flow communication with the cap chamber 26. A pressure actuated valve 38 is attached to nozzle 20 with a connector 40. Connector 40 allows for flow between the cap chamber 26 and nozzle passageway 22.

Pressure actuated valve 38 has an at rest position shown in FIG. 2 wherein the air passageway 36 is closed and air cannot flow from the air passageway 36 into the cap chamber 26. In the under pressure position, shown in FIG. 3, the pressure actuated valve 38 is opened or deformed such that air can flow from the air passageway 36 into the cap chamber 26.

Figure 3:
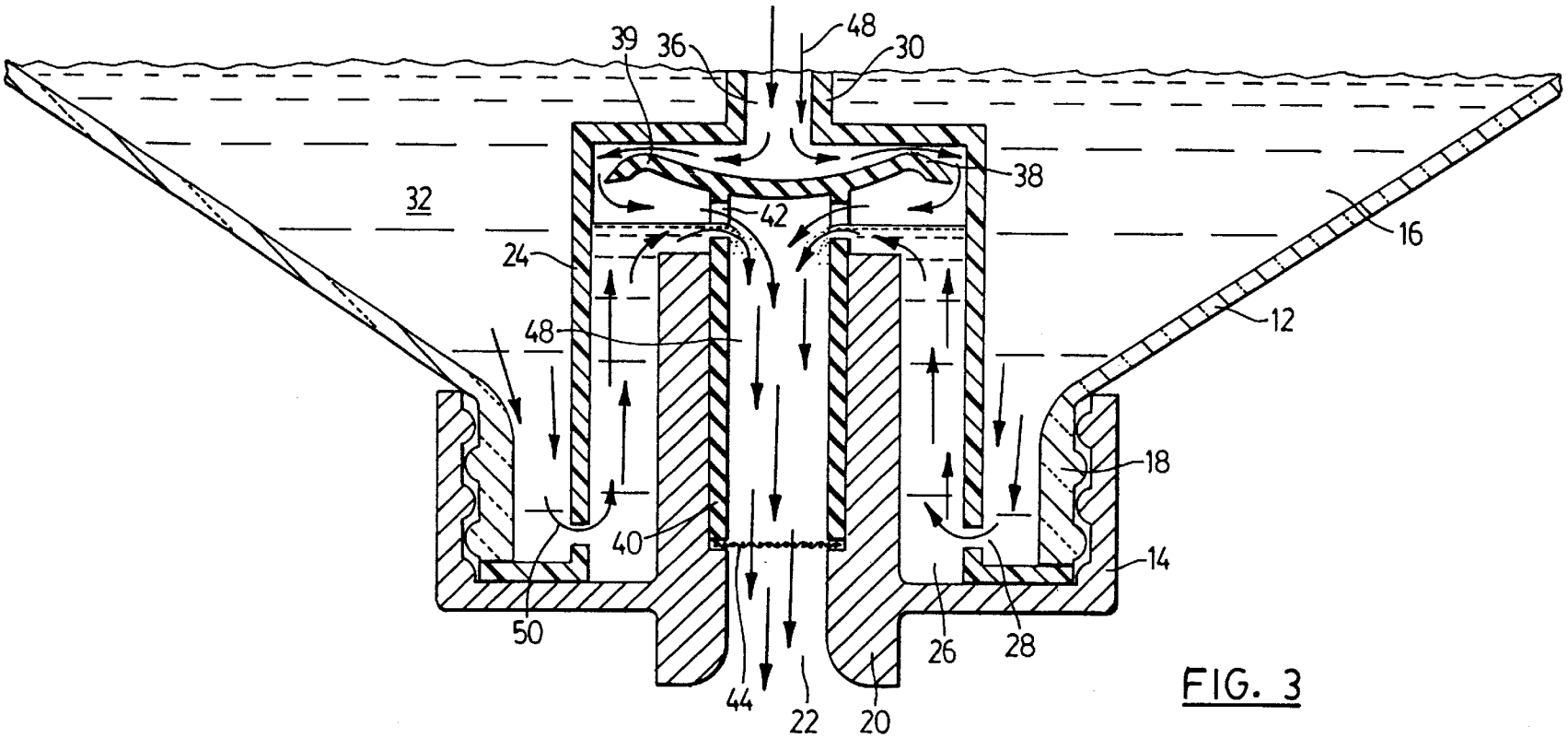
FIG. 3 is an enlarged sectional view of the nozzle in the under pressure position.

Referring to FIGS. 1 to 3, pressure actuated valve 38 is a flexible valve and connector 40 includes a pair of connector ports 42 which provide a fluid passageway between cap chamber 26 and nozzle passageway 22. It will be appreciated by those skilled in the art that one connector port 42 or a plurality of connector ports 42 could be used. Further, it will be appreciated by those skilled in the art that other pressure actuated valve mechanisms could also be used. For example, a ball and spring, a diaphragm, reed, sprung discs and the like could be used.

A porous material such as gauze 44 is positioned at the outer end of connector 40 in the nozzle 20 such that gauze 44 is proximate to the bottom end of the nozzle when it is positioned downwardly. Mixing occurs between the gauze 44, connector 40, and pressure actuated valve 38 and in the cap chamber 26. Connector ports 42 allow air, foaming liquid 32 and a combination thereof to flow into connector 40.

The sizes of the nozzle 20, nozzle passageway 22, cap chamber 26, cover ports 28, air passageway 36 and connector ports 42 are arranged such that in the at rest position with the throat 18 of the bottle 12 positioned downwardly and the pressure actuated valve 38 in the closed position an airlock is created between the nozzle 20 and nozzle cover 24 in the cap chamber 28. Thereafter when the bottle 12 is moved from the at rest position to the under pressure position, shown in FIG. 3, the air moves down the air tube 30 causing the pressure actuated valve 38 to open and air to flow into the cap chamber 26 and connector 40 as shown by arrows 48. At the same time the air lock is broken and liquid 32 flows through cover ports 28 into the cap chamber 26 and into connector 40 as shown by arrows. In the mixing area the air and the liquid are mixed and then are forced through the gauze 44 to form a foam. When the pressure is released, bottle 12 resumes its original shape causing a vacuum in the bottle and drawing air up the air passageway 36 closing pressure actuated valve 38. Effectively in the at rest position nozzle 20 creates a dam and the air pressure in the cap chamber 26 is higher than the upward liquid 32 pressure so that the liquid does not drip out nozzle passageway 22.

In one example, for foaming liquid which is a foaming soap with a density of 1.022 g/cm$^3$ and a viscosity of 40–50 cps, air passageway 36 has a bore diameter of 6.55 mm; the annular cap chamber 26 has a width of 0.25 mm; a pair of cover ports 28 have diameters of 1.8 mm; and the valve 38 opening pressure is 15–20 mbar.

It will be appreciated by those skilled in the art that nozzle cover 24 can be fixedly or releasably attached to cap 14. Similarly cap 14 can be fixedly or releasably attached to throat 18.

Figure 4:
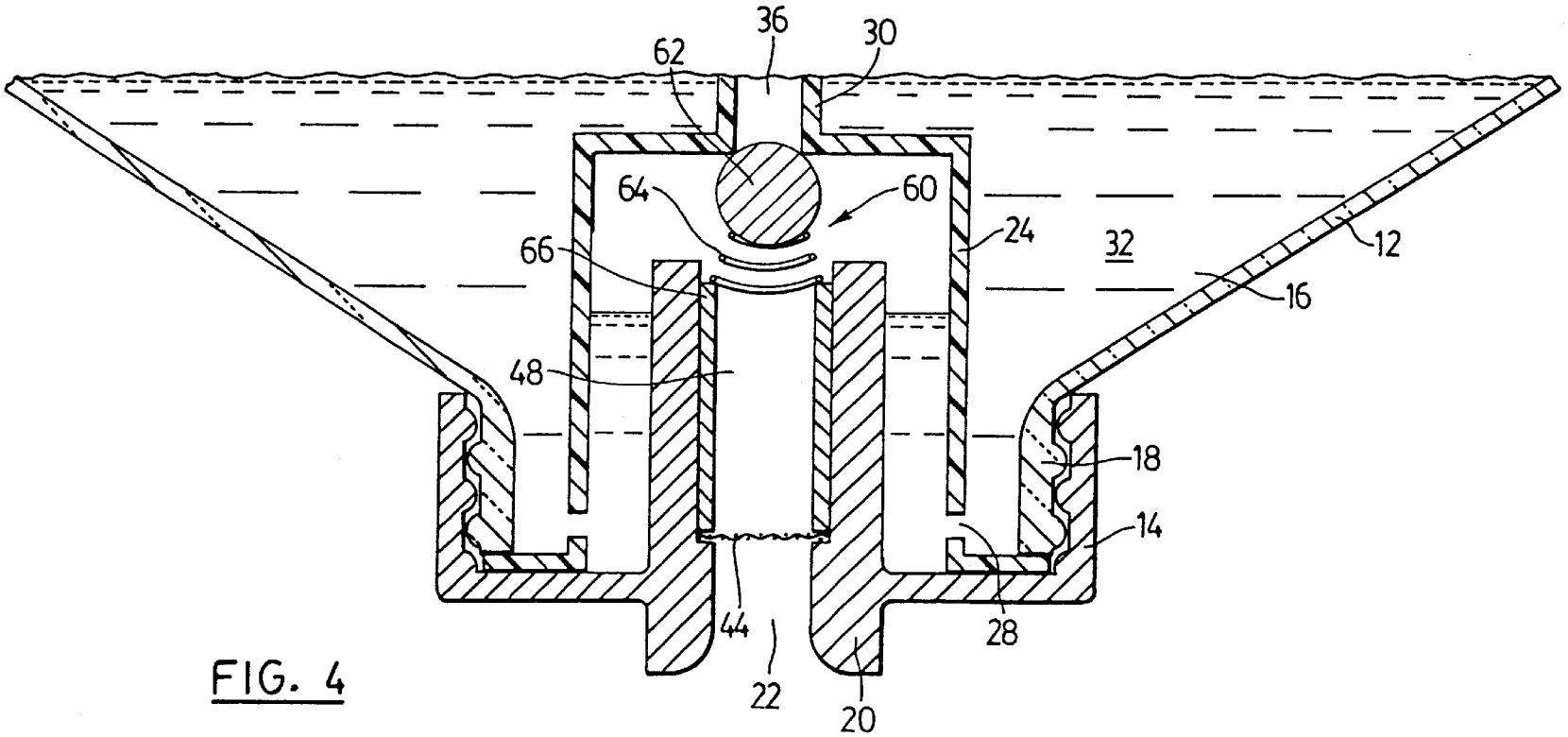
FIG. 4 is an enlarged section view of an alternate embodiment of the foam nozzle of the present invention shown in the at rest position.
Figure 5:
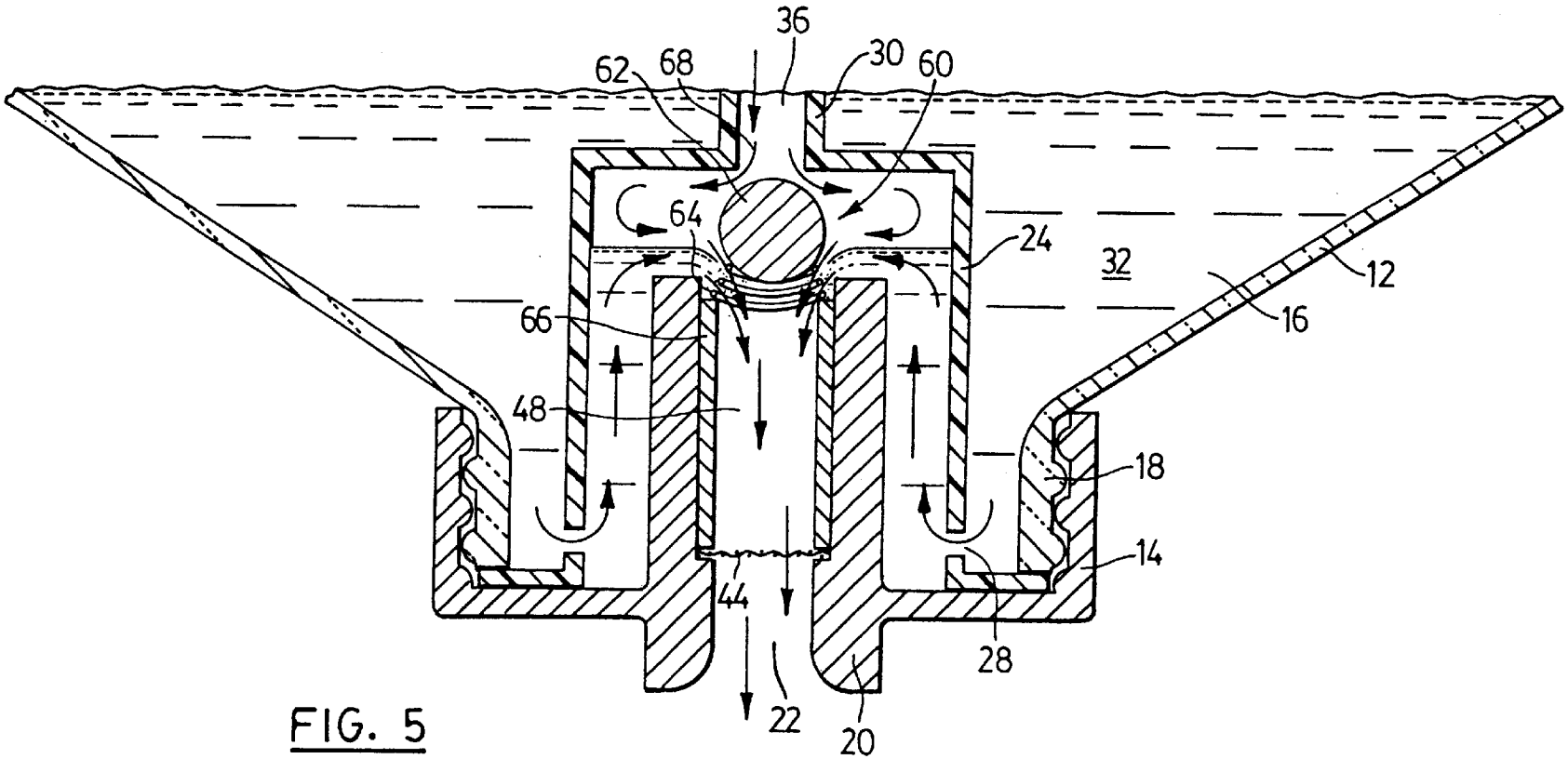
FIG. 5 is an enlarged section view of the alternate embodiment of the foam nozzle similar to that shown in FIG. 4 but shown in the under pressure position.
Figure 6:
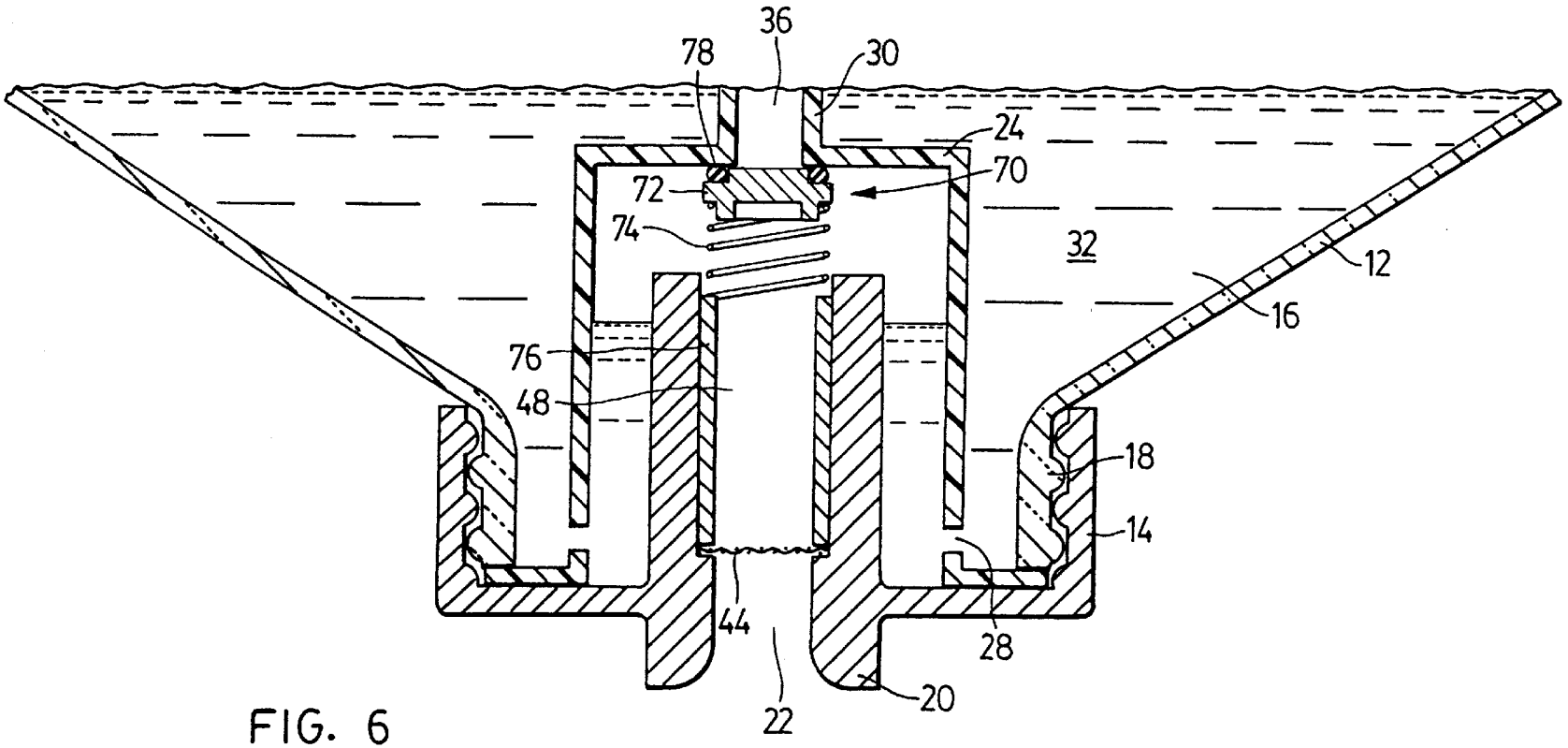
FIG. 6 is an enlarged section view of a second alternate embodiment of the foam nozzle of the present invention shown in the at rest position.
Figure 7:
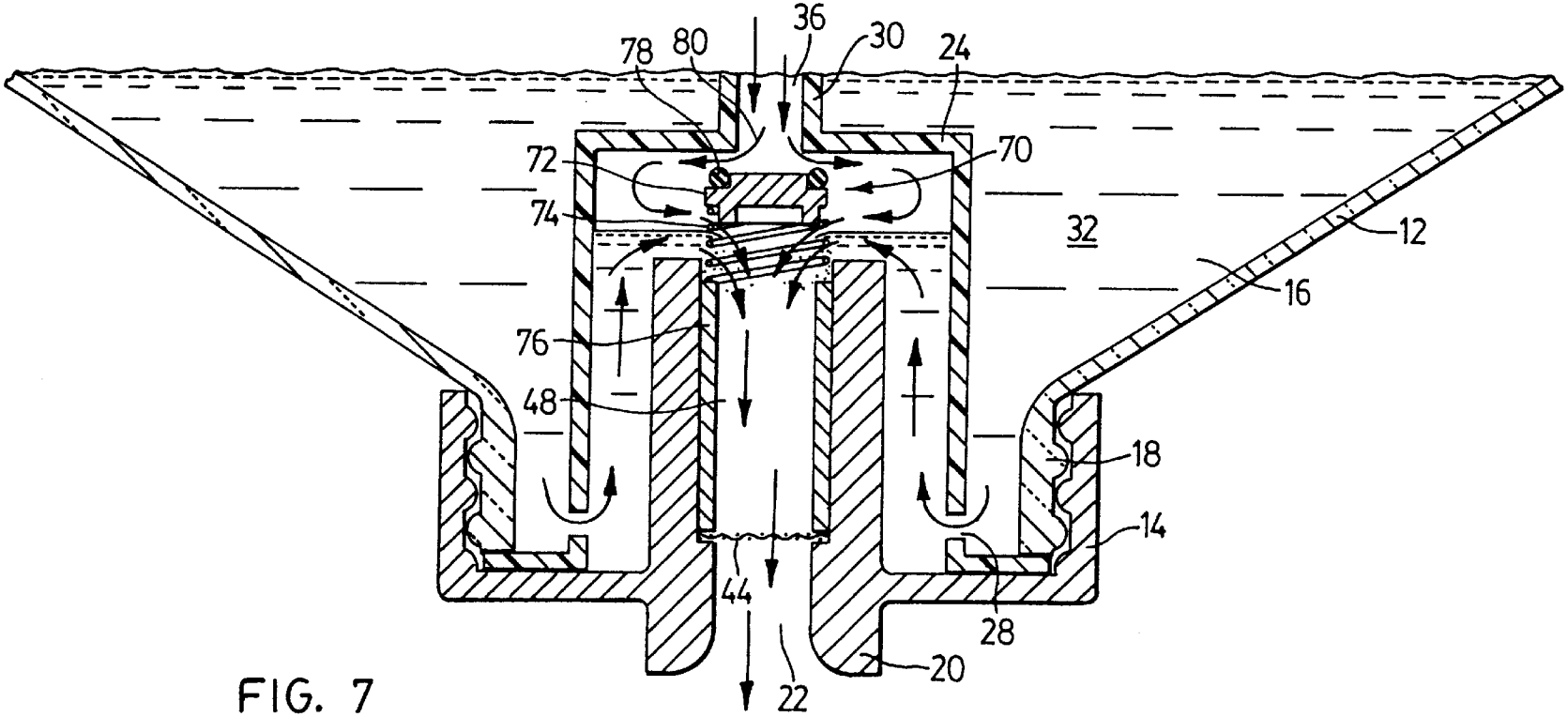
FIG. 7 is an enlarged section view of the second alternate embodiment of the foam nozzle similar to that shown in FIG. 6 but shown in the under pressure position.

It will be appreciated by those skilled in the art that a number of different valve arrangements could be used. One alternative is shown in FIGS. 4 and 5 and a second alternative is shown in FIGS. 6 and 7. Hereinafter two alternate valve arrangements will be discussed and only those portions that are different will be discussed.

Referring to FIGS. 4 and 5, valve 60 includes a ball 62, a spring 64 and spring seat 66. Spring seat 66 is positioned in nozzle passageway 22. Spring 64 biases the ball 62 into the closed or the at rest position wherein ball 62 closes air passageway 36 as shown in FIG. 4. Under pressure spring 64 is compressed and the ball moves away from the air passageway 36 thus allowing air from the air passageway 36 into cap chamber 26 and nozzle passageway 22 as shown by arrow 68 in FIG. 5.

Referring to FIGS. 6 and 7, valve 70 includes a stopper 72, a spring 74 and spring seat 76. Spring seat 76 is positioned in nozzle passageway 22. Stopper 72 includes an O-ring 78. Spring 74 biases the stopper 72 into the closed or the at rest position wherein the O-ring 78 on stopper 72 rests against the nozzle cover 24 proximate to the air passageway 36 thus closing air passageway 36 as shown in FIG. 6. Under pressure spring 74 is compressed and the stopper 72 moves away from the air passageway 36 thus allowing air from the air passageway 36 into cap chamber 26 and nozzle passageway 22 as shown by arrow 80 in FIG. 7.

Figure 8:
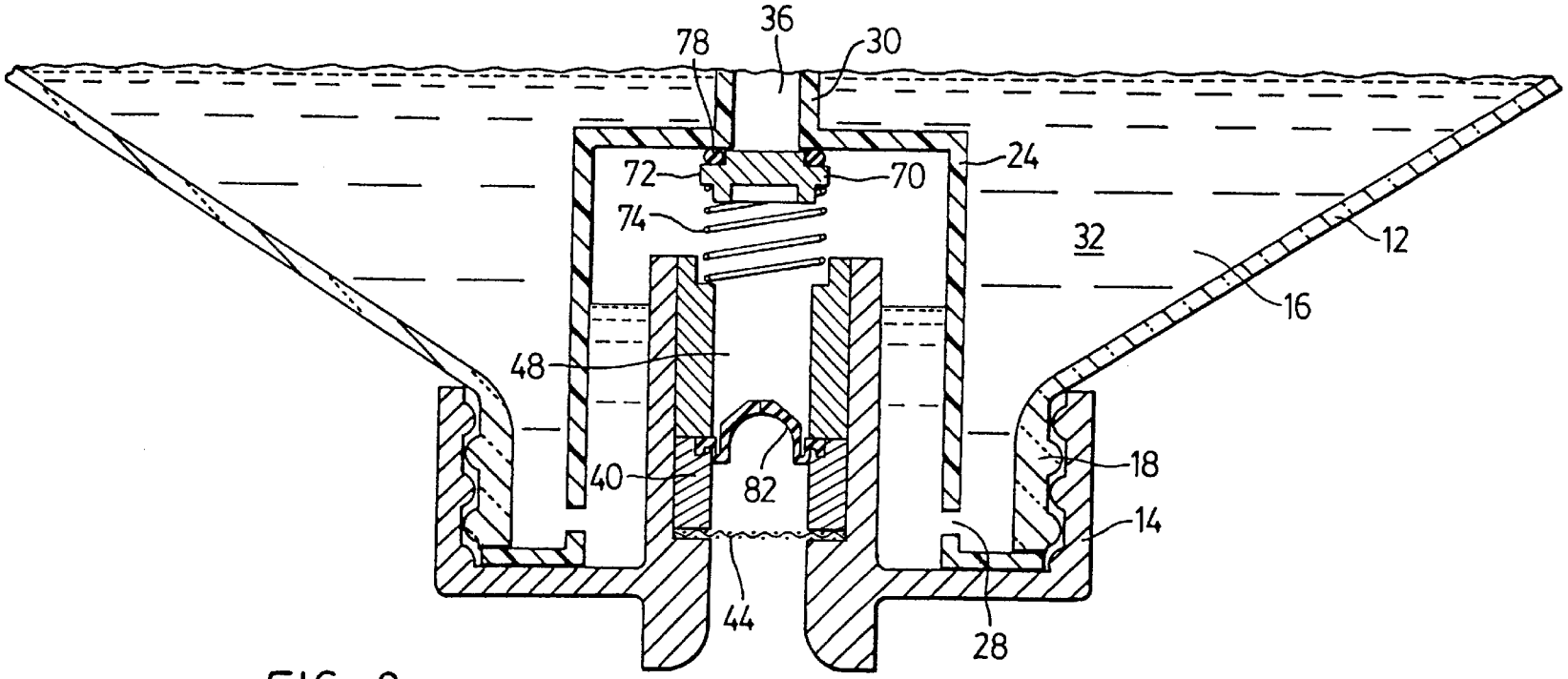
FIG. 8 is an enlarged section view of a third alternate embodiment of the foam nozzle of the present invention similar to that shown in FIG. 8 but including a pressure retaining valve and the nozzle is shown in the at rest position.
Figure 9:
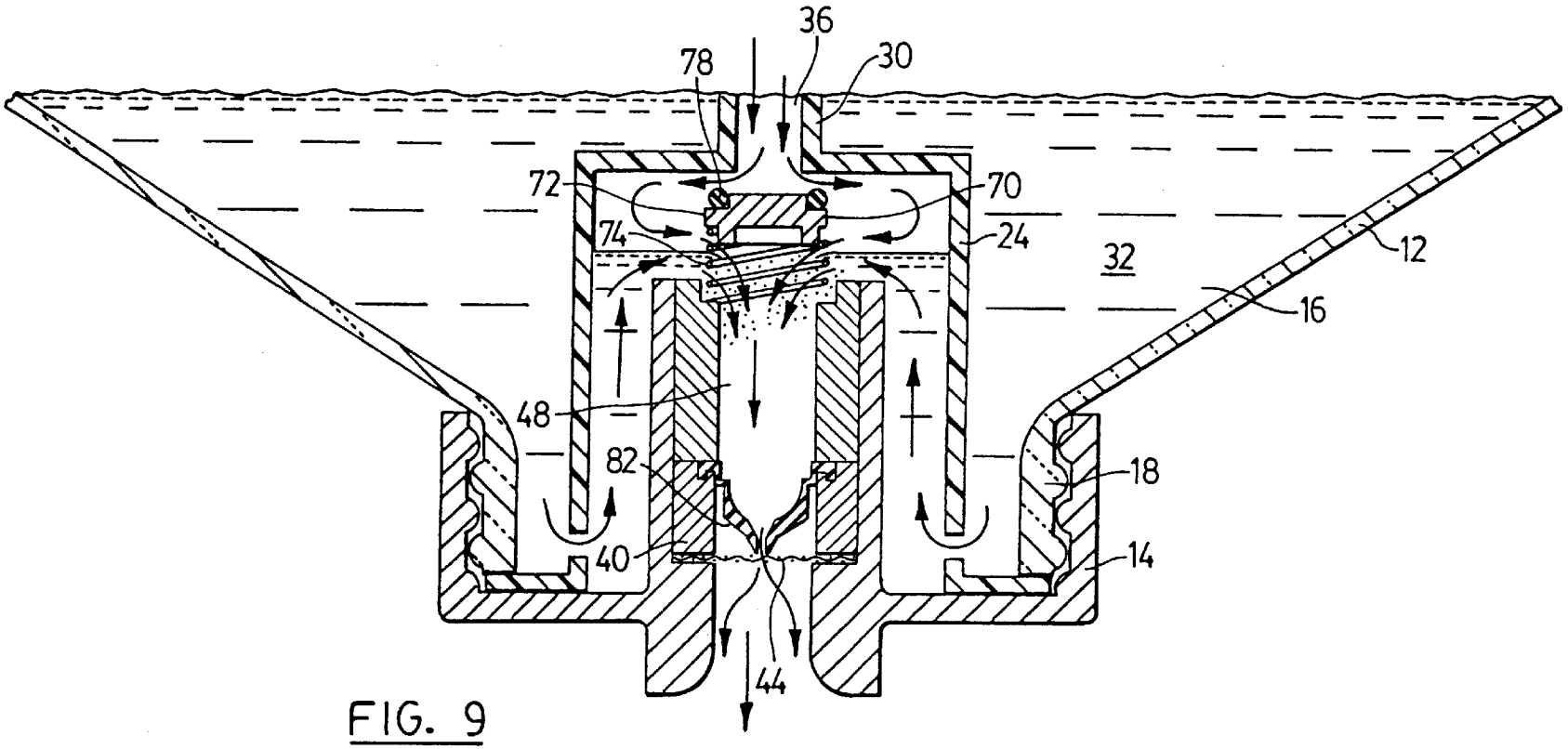
FIG. 9 is an enlarged section view of the third alternate embodiment of the foam nozzle similar to that shown in FIG. 6 but shown in the under pressure position.

Referring to FIGS. 8 and 9 a nozzle similar to that shown in FIGS. 6 and 7 is shown but the nozzle further includes an elastomeric valve 82. Elastomeric valve is situated in the nozzle passageway 22 above the gauze 44. Elastomeric valve 82 is a pressure retaining valve that has an opening pressure that is high on the exhaust stroke but low on the intake stroke. The addition of the elastomer valve 82 provides increased assurance that the squeeze operated foam dispenser will not leak when not in use. It has been noted that in environments where there are large fluctuations of temperature the addition of the elastomeric valve 82 is of greater importance. An example of an elastomeric valve assembly that can be used in this application is a standard Zeller Plastik™ assembly part #4054.

Figure 10:
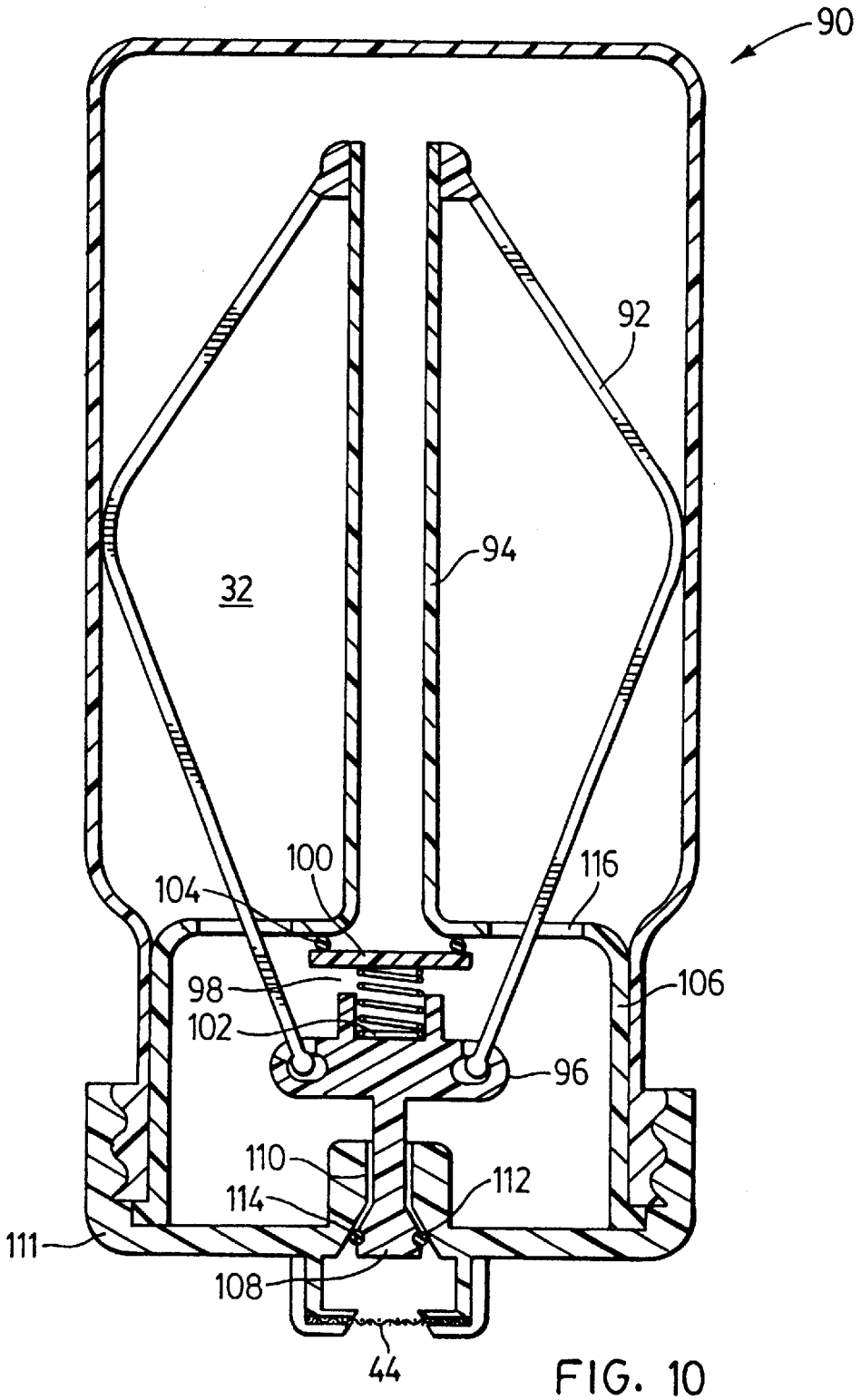
FIG. 10 is a sectional view of a liquid dispenser showing a fourth alternate embodiment of the foam nozzle of the present invention including an alternate mechanical pressure retaining valve and the nozzle is shown in the at rest position.
Figure 11:
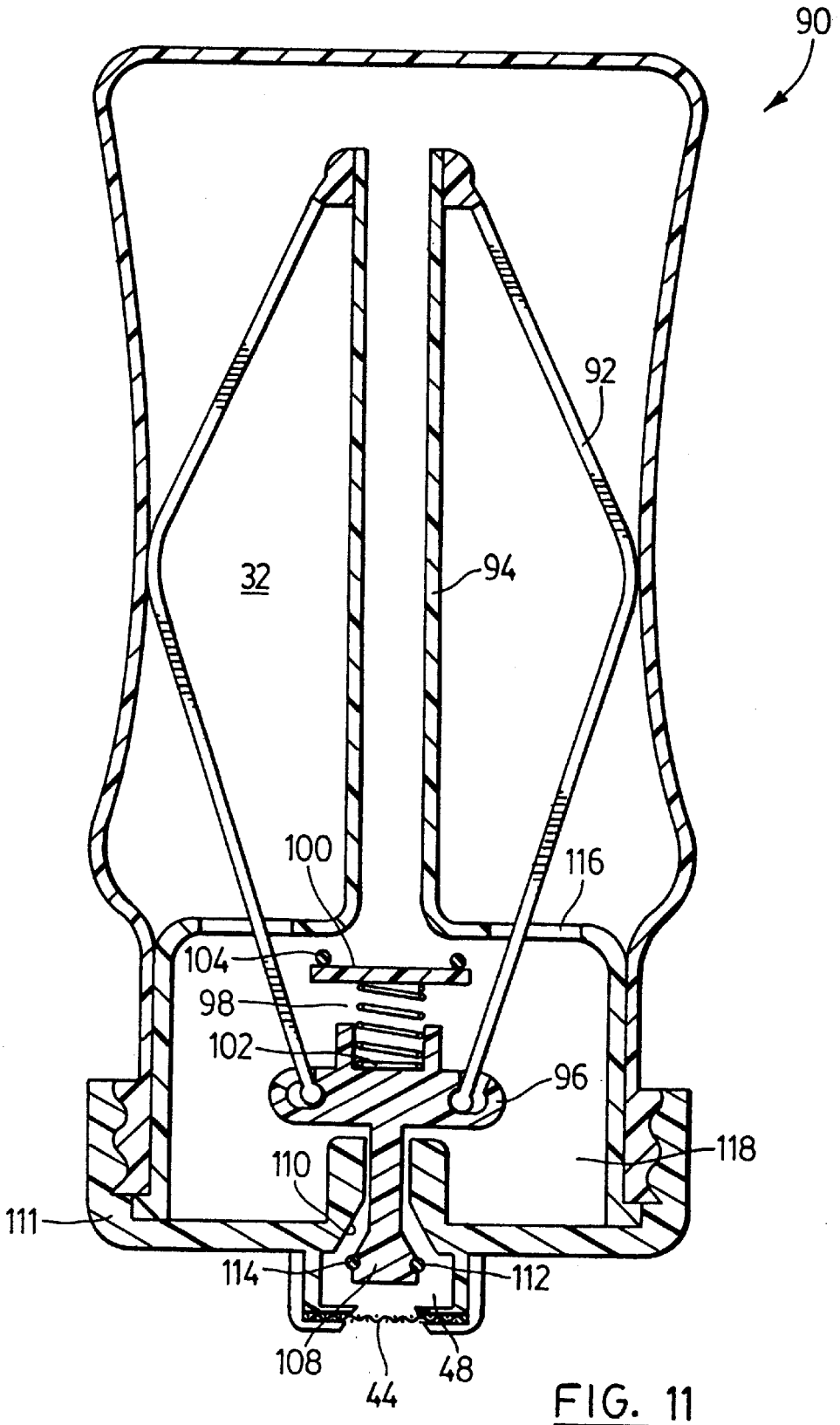
FIG. 11 is a sectional view of the liquid dispenser shown in FIG. 10 but shown in the under pressure position.

Referring to FIGS. 10 and 11 an alternate pressure retaining valve system is used with the squeeze operated foam dispenser 90. Dispenser 90 is similar to those described above but it includes and alternate pressure retaining valve Following is a discussion of only those parts of dispenser 90 that are different from those described above. Dispenser 90 includes a spring 92 which is preferably constructed from plastic. Spring 92 is pivotally attached between air tube 94 and piston 96. A valve 98 similar to valve 70 is seated on piston 96 at one end thereof. Valve 98 includes a stopper 100, a spring 102 and an O-ring 104. Spring 102 biases the stopper 100 into the closed or the at rest position wherein the O-ring 104 on stopper 100 rests against the nozzle cover 106 proximate to the air tube 94 thus closing air tube 94 as shown in FIG. 10.

Piston 96 includes a piston stopper 108 for sealing a nozzle 110 in cap 111. O-ring 112 on piston stopper 108 seals against piston stopper seat 114 formed in nozzle 110. Gauze 44 is positioned at the mouth of nozzle 110. A pair of cover ports 116 provide a fluid passageway between the interior 16 and the cap chamber 118.

When dispenser 90 is squeezed, springs 92 deform and piston stopper 108 moves out of the sealed position and there is a pressure build up such that spring 102 is compressed and the stopper 104 moves away from the air passageway 94 thus allowing air from the air passageway 94 into cap chamber 118 as shown in FIG. 11. Mixing then occurs between the foaming liquid 32 and the air in the cap chamber 118 and nozzle 110.

One of the advantages of the squeeze operated foam dispenser of the present invention is that it reduces drips after use. When the pressure is released, the bottle 12 returns to its original shape and air is sucked back up air tube 30 and sucked into cap chamber 26 thus cleaning residual liquid and foam from the nozzle passageway 22.

Preferably bottle 12 will be attached to a wall such that the throat 18 is always positioned downwardly. However it will be appreciated by those skilled in the art the foam dispenser described herein need not always be attached to the wall. In addition bottle 12 could be used in association with a lever mechanism, electric solenoid, motors and the like arranged to exert pressure on the bottle.

It will be appreciated that the above description was with regard to foaming liquids and in particular foaming soaps. However the liquid dispenser could also be used with other foaming detergents or other liquids wherein mixing with air is advantageous.

It will be appreciated that the above description relates to the invention by way of example only. Many variations on the invention will be obvious to those skilled in the art and such obvious variations are within the scope of the invention as described herein whether or not expressly described.

What is claimed as the invention is:

1. A foam dispenser for use in association with foaming liquids comprising:

a resiliently deformable bottle having an interior and a throat, the resiliently deformable bottle having an at rest position and an under pressure position;

a cap attached to the throat, the cap having a nozzle extending inwardly into the interior and the nozzle defining a nozzle fluid passageway;

a nozzle cover attached to the cap and spaced from the nozzle defining a cap chamber therebetween;

an air tube defining an air passageway extending inwardly from the nozzle cover, the air passageway being in flow communication with the cap chamber and an interior portion of air formed between the liquid and the bottle in the interior thereof when the nozzle is positioned downwardly;

a pressure actuated valve for selectively opening and closing the air tube whereby the valve is closed when the bottle is in the at rest position and opens responsive to the bottle being moved from the at rest position to the under pressure position such that air flows through the air passageway from the interior portion of the bottle into the cap chamber and responsive to the bottle being moved from the under pressure position to the at rest position a vacuum is formed in the interior of the bottle drawing up air from the cap chamber and closing the valve;

a cover port formed in the nozzle cover providing a fluid passageway between the interior of the bottle and the cap chamber; and a means for sealing the nozzle when the bottle is in the at rest position.

2. A foam dispenser as claimed in claim 1 further including a porous material positioned in the nozzle fluid passageway wherein the nozzle fluid passageway between the porous material and the nozzle cover defines a mixing chamber wherein in the under pressure position air and liquid are mixed and then forced through the porous material to form a foam.

3. A foam dispenser as claimed in claim 2 wherein the valve includes a flexible portion covering the air tube and a connector connecting the flexible portion to the nozzle, the connector having a connector port formed therein, wherein the flexible portion is responsive to the bottle being moved from the at rest position to the under pressure position.

4. A foam dispenser as claimed in claim 3 wherein the cover port is a first cover port and further including a second cover port.

5. A foam dispenser as claimed in claim 4 wherein the connector port is a first connector port and further including a second connector port.

6. A foam dispenser as claimed in claim 3 wherein the sealing means includes the cover port, the nozzle and the nozzle cover arranged whereby in the at rest position with the throat of the bottle positioned downwardly there is an airlock between the nozzle and nozzle cover in the cap chamber and when the bottle is moved from the at rest position to the under pressure position the air lock is broken and the liquid in the interior of the bottle flows through the cover port into the cap chamber and out the nozzle fluid passageway.

7. A foam dispenser as claimed in claim 2 wherein the valve includes a ball and a spring wherein the spring biases the ball into the closed position covering the air tube and the spring is responsive to the bottle being moved from the at rest position to the under pressure position moving the ball and opening the air tube.

8. A foam dispenser as claimed in claim 7 wherein the sealing means includes the cover port, the nozzle and the nozzle cover arranged whereby in the at rest position with the throat of the bottle positioned downwardly there is an airlock between the nozzle and nozzle cover in the cap chamber and when the bottle is moved from the at rest position to the under pressure position the air lock is broken and the liquid in the interior of the bottle flows through the cover port into the cap chamber and out the nozzle fluid passageway.

9. A foam dispenser as claimed in claim 2 wherein the valve includes a stopper and a spring wherein the spring biases the stopper into the closed position covering the air tube and the spring is responsive to the bottle being moved from the at rest position to the under pressure position moving the stopper and opening the air tube.

10. A foam dispenser as claimed in claim 9 wherein the sealing means includes the cover port, the nozzle and the nozzle cover arranged whereby in the at rest position with the throat of the bottle positioned downwardly there is an airlock between the nozzle and nozzle cover in the cap chamber and when the bottle is moved from the at rest position to the under pressure position the air lock is broken and the liquid in the interior of the bottle flows through the cover port into the cap chamber and out the nozzle fluid passageway.

11. A foam dispenser as claimed in claim 2 wherein the sealing means includes the cover port, the nozzle and the nozzle cover arranged whereby in the at rest position with the throat of the bottle positioned downwardly there is an airlock between the nozzle and nozzle cover in the cap chamber and when the bottle is moved from the at rest position to the under pressure position the air lock is broken and the liquid in the interior of the bottle flows through the cover port into the cap chamber and out the nozzle fluid passageway.

12. A foam dispenser as claimed in claim 2 wherein the cover port, the nozzle and the nozzle cover are arranged whereby in the at rest position with the throat of the bottle positioned downwardly there is an airlock between the nozzle and nozzle cover in the cap chamber and when the bottle is moved from the at rest position to the under pressure position the air lock is broken and the liquid in the interior of the bottle flows through the cover port into the cap chamber and out the nozzle fluid passageway.

13. A foam dispenser for use in association with foaming liquids comprising:

a resiliently deformable bottle having an interior and a throat, the resiliently deformable bottle having an at rest position and an under pressure position;

a cap attached to the throat, the cap having a nozzle extending inwardly into the interior and the nozzle defining a nozzle fluid passageway;

a nozzle cover attached to the cap and spaced from the nozzle defining a cap chamber therebetween;

an air tube defining an air passageway extending inwardly from the nozzle cover, the air passageway being in flow communication with the cap chamber and an interior portion of air formed between the liquid and the bottle in the interior thereof when the nozzle is positioned downwardly;

a pressure actuated valve for selectively opening and closing the air tube whereby the valve is closed when the bottle is in the at rest position and opens responsive to the bottle being moved from the at rest position to the under pressure position;

a cover port formed in the nozzle cover providing a fluid passageway between the interior of the bottle and the cap chamber;

a porous material positioned in the nozzle fluid passageway such that the nozzle fluid passageway between the porous material and the nozzle cover defines a mixing chamber wherein in the under pressure position air and liquid are mixed and then forced through the porous material to form a foam; and a means for sealing the nozzle when the bottle is in the at rest position including a pressure retaining valve positioned in the nozzle upstream of the porous material.

14. A foam dispenser as claimed in claim 13 wherein the pressure retaining valve is an elastomeric valve.

15. A foam dispenser as claimed in claim 13 wherein the valve includes a flexible portion covering the air tube and a connector connecting the flexible portion to the nozzle, the connector having a connector port formed therein, wherein the flexible portion is responsive to the bottle being moved from the at rest position to the under pressure position.

16. A foam dispenser as claimed in claim 13 wherein the valve includes a ball and a spring wherein the spring biases the ball into the closed position covering the air tube and the spring is responsive to the bottle being moved from the at rest position to the under pressure position moving the ball and opening the air tube.

17. A foam dispenser as claimed in claim 16 wherein the pressure retaining valve is an elastomeric valve.

18. A foam dispenser as claimed in claim 13 wherein the valve includes a stopper and a spring wherein the spring biases the stopper into the closed position covering the air tube and the spring is responsive to the bottle being moved from the at rest position to the under pressure position moving the stopper and opening the air tube.

19. A foam dispenser as claimed in claim 17 wherein the pressure retaining valve is an elastomeric valve.

20. A foam dispenser as claimed in claim 13 wherein the pressure retaining valve includes a piston slidably mounted in the nozzle and having a piston stopper, a piston stopper seat formed in the nozzle and a spring whereby squeezing the bottle causes the spring to deform and open the pressure retaining valve.

* * * * *